US006010550A

United States Patent [19]

Song

[11] Patent Number: 6,010,550

[45] Date of Patent: Jan. 4, 2000

[54] AIR FILTER FOR A VACUUM CLEANER

[76] Inventor: Young-So Song, 5-103 Kaepo 1-Cha Woosung Apt., 503 Daechi 1-Dong, Kangnam-gu, Seoul, Rep. of Korea

[21] Appl. No.: 09/217,620

[22] Filed: Dec. 22, 1998

[30] Foreign Application Priority Data

Aug. 20, 1998 [KR] Rep. of Korea ..... 98-15646

[51] Int. Cl.[7] ..... B01D 53/04

[52] U.S. Cl. ..... 55/482; 55/485; 55/500; 55/529; 55/DIG. 3; 96/223

[58] Field of Search ..... 55/482, 485, 486, 55/488, 529, DIG. 3, DIG. 8, 500; 96/223, FOR 175; 261/DIG. 65

[56] References Cited

U.S. PATENT DOCUMENTS 5,248,323 9/1993 Stevenson ..... 55/DIG. 3
5,287,591 2/1994 Rench et al. ..... 55/DIG. 3
5,307,538 5/1994 Rench et al. ..... 55/DIG. 3
5,498,272 3/1996 Leon ..... 55/DIG. 3

*Primary Examiner*—David A. Simmons
*Assistant Examiner*—Minh-Chau T. Pham
*Attorney, Agent, or Firm*—Bacon & Thomas

[57] ABSTRACT

An air filter for a vacuum cleaner to easily clear floors, carpets, chairs and so on includes a the main body having a motor and a deflation hole installed in a dust collector having an intake port, and a filter means provided between the dust collector and the main body, wherein the main body includes a fixing part formed in the middle of the bottom part to secure an outlet filter and having a peripheral stepped portion in a downward conic-shape to mount a fixing frame having a number of intake slit and the filter means to be installed to the fixing frame includes an activated charcoal filter, a dust removing filter and a static electricity filter to remove sludge, stink, offensive smell and gas generated from various materials in a room by means of these filters being easy to install in the vacuum cleaner.

10 Claims, 6 Drawing Sheets

AIR FILTER FOR A VACUUM CLEANER

TECHNICAL FIELD

The present invention relates to an air filter for a vacuum cleaner to easily clear floors, carpets, chairs and so on in the manner of vacuum intake, wherein an activated charcoal filter impregnating activated charcoal, a dust removing filter for filtering the dust of minute particles, a static electricity filter charged with static electricity are further provided to remove sludge, stink, offensive smell and gas generated from various materials in a room by means of these filters and easy to install in the vacuum cleaner.

BACKGROUND ART

Conventionally, a vacuum cleaner includes a blower motor for making a vacuum state and an envelope-type filter in a main body, so that sludge is introduced into the main body of the cleaner by the vacuum power generated by driving the motor, and filtered by the filter, making filth residue in the main body of the cleaner, thereby only the air passing through the filter deflates through a deflation hole provided in an upper part of the main body.

The conventional filter has disadvantages that it is impossible to remove the gas including minute dust of odor, since the conventional filter provided in the main body of the cleaner as described above is made of mat-shape porous net, so that it filters merely the sludge having relatively large-sized particles, which is introduced into the main body of the cleaner by the vacuum power.

Therefore, the conventional filter as the above has defects that it can collect and discard only trash, but fails to remove contaminants substantially, and to prevent the air from contaminating since the minute dust, gas, and odor are deflated through the deflation hole when air is deflated after collecting the sludge. Especially, it has been worried about fire or explosion due to sparks generated by the cleaner motor etc., because the filters can not purify inflammable gas, harmful gas and so on, in case that these gases are sucked into the cleaner. Therefore, it is difficult to use the cleaner in the place where the inflammable gas or harmful gas would be generated, and it has to comprise extra purification devices to remove the gas, dust and odor.

SUMMARY OF THE INVENTION

The present invention was derived to overcome the problems encountered in the conventional filters. It is an object of the present invention to provide an air filter for a vacuum cleaner, in which the vacuum cleaner can easily clear floors, carpets, chairs and so on in the manner of vacuum intake, by means of an activated charcoal filter including the activated charcoal, a dust removing filter for filtering dust of minute particles, a static electricity filter charged with static electricity to remove harmful substances generated in a room, for example, gas or odor from adhesives used in wallpapers or furniture, gas or odor from chemical materials of construction materials, carbon monoxide and carbon dioxide from cooking, and exhaust gas of vehicles sucked from the outdoor, and to install the filters easily and certainly.

These objects will become apparent from the following description taken together with the accompanying drawings.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DISCLOSURE OF THE INVENTION

Figure 1:
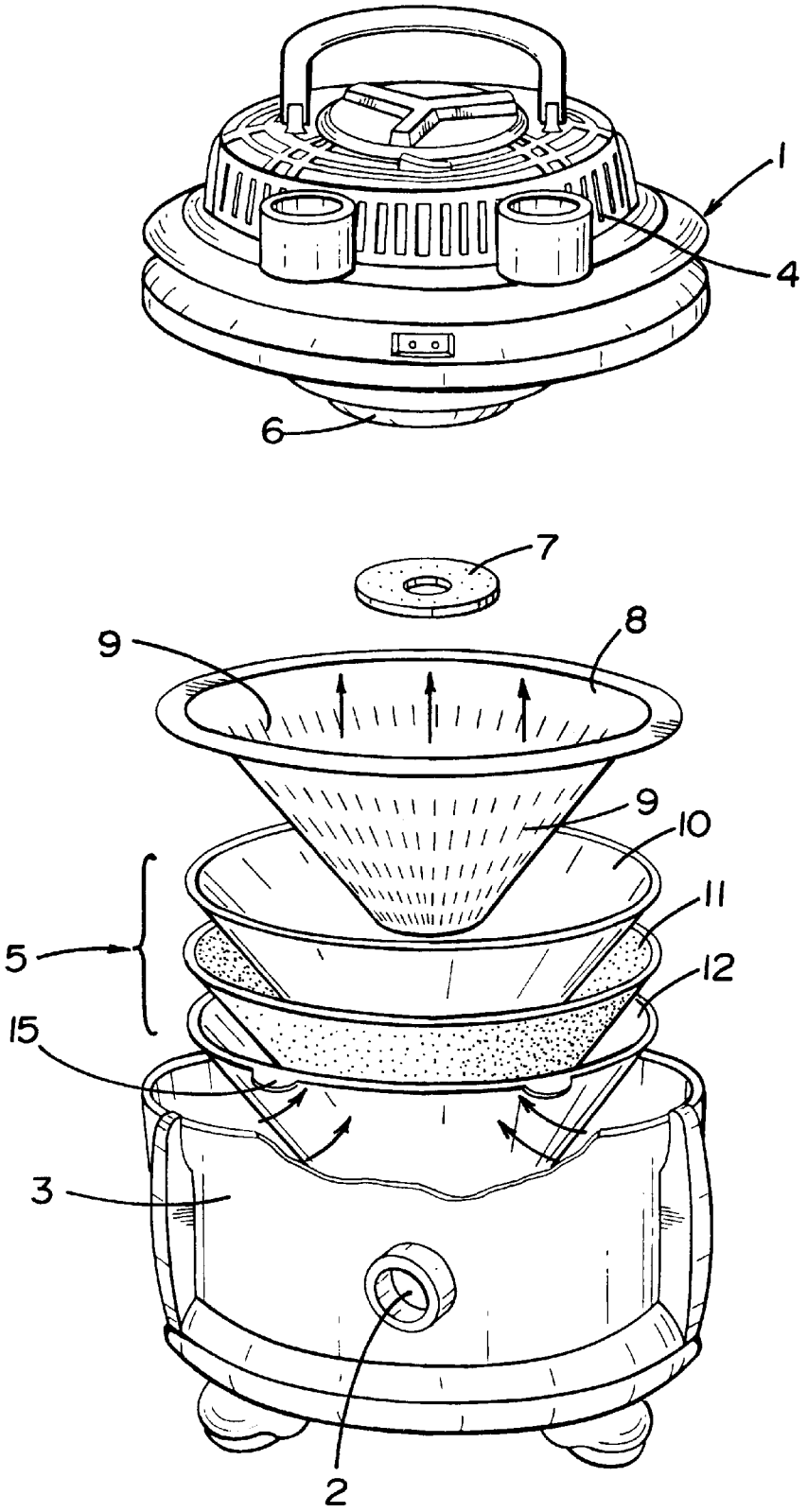
FIG. 1 is a schematic exploded perspective view of an air filter according to a preferred embodiment of the present invention.

FIG. 1 shows the construction of an air filter according to a preferred embodiment of the present invention. Referring to FIG. 1, in a vacuum cleaner, a main body 1 having a motor for originating vacuum and a deflation hole 4 is installed in a dust collector 3 having an intake port 2, and a filter means 5 is provided between the dust collector 3 and the main body 1. In the main body 1, a fixing part 6 is formed in the middle of a bottom part to secure an outlet filter 7 and a peripheral stepped portion is formed downwardly in a conic-shape in the fixing part 6. A fixing frame 8 formed with a number of intake slit 9 is rotatably mounted to the fixing part 6, and the filter means 5 is installed under the fixing frame 8.

The filter means 5, which is installed under the fixing frame 8, includes a static electricity filter 10 which is charged with static electricity, an activated charcoal filter 11 made of non-woven, papers, textiles, etc., impregnating the activated charcoal therein, and a dust removing filter 12 surrounding the periphery of the activated charcoal filter 11, wherein the filters 10, 11, 12 are formed conically to be provided successively under the fixing frame 8.

The filter means 5 as above may be formed by different arrangement, for example, the static filter 10 and the dust removing filter 12 are disposed outside the fixing frame 8 in sequence and, the activated charcoal filter 11 is disposed inside the fixing frame 8.

Figure 2:
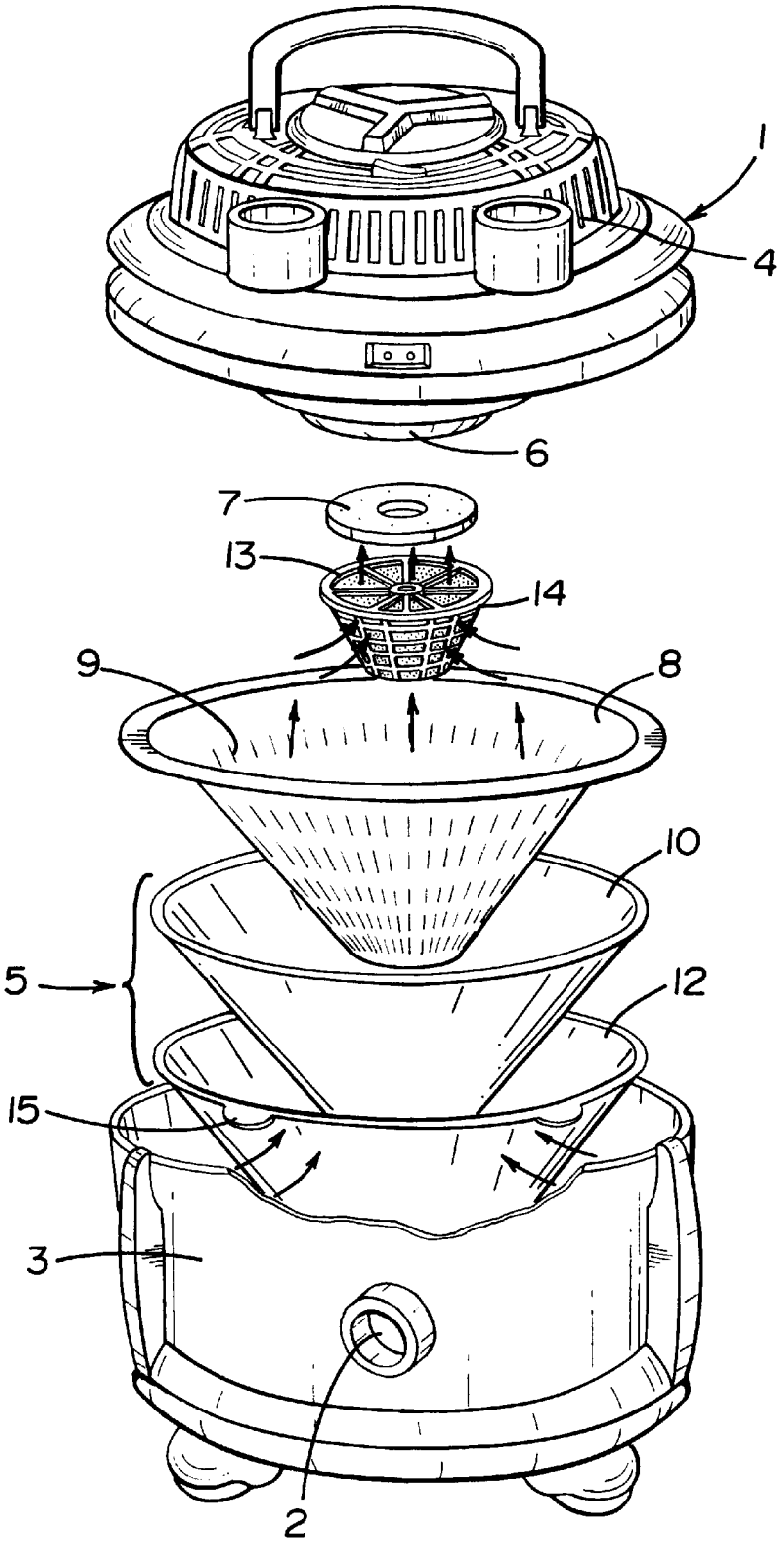
FIG. 2 is a schematic exploded perspective view showing an air filter according to another embodiment of the present invention.

Referring to FIG. 2, the activated charcoal filter 11 may be formed with a container 13 of resin and a ventilative bag to be inserted in the container 13. The ventilative bag is made of non-woven or textile net impregnating the activated charcoal in its net. Also, the ventilative bag may be put with activated charcoal granules in its inner space, wherein the activated charcoal can be received in the form of cake or can be piled up.

Also, the activated charcoal filter 11 and the dust removing filter 12 of the filter means 5 are respectively formed with a plurality of wings 15 in their upper periphery, to confirm stable mounting of the activated charcoal filter 11 and the dust removing filter 12 by means of these wings 15.

In the present invention described as above, the filter means 5 as shown in FIG. 1 is formed as conic-shape with joining the static electricity filter 10 charged with static electricity, the activated charcoal filter 11 made of non-woven, filter papers, textiles, etc., impregnating the activated charcoal therein, and the dust removing filter 12 which is provided to the activated charcoal filter 11 by sewing or sticking thereto as it shields the periphery of the activated charcoal filter 11. Thereafter, the outlet filter 7 is mounted to the fixing frame 6, which is formed in the center of the bottom part of the main body 1 and having the deflation hole 4. The fixing frame 8 formed with the number of intake slit 9 is rotatably mounted to the fixing part 6 via the outlet filter 7. Then, the filter means 5 including the static electricity filter 10, the activated charcoal filter 11, and the dust removing filter 12 is coupled to the fixing frame 8.

Figure 3:
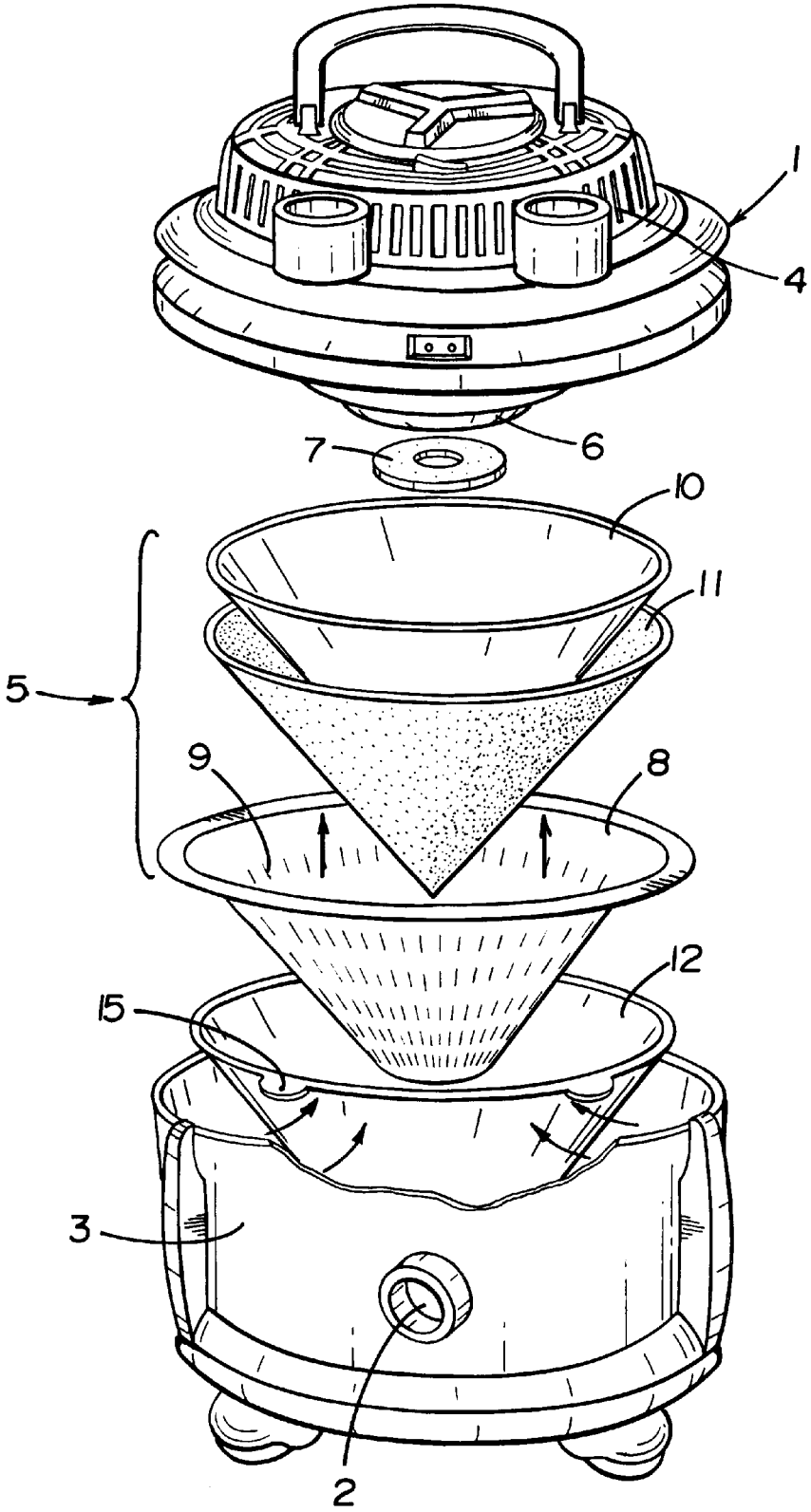
FIG. 3 is a schematic exploded perspective view showing an air filter according to another embodiment of the present invention.
Figure 4:
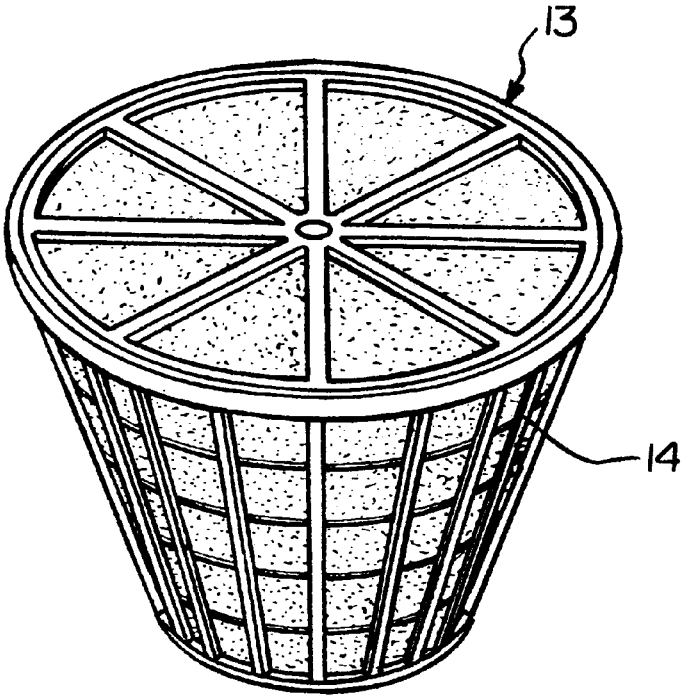
FIG. 4 is a schematic perspective view showing the construction of an activated charcoal filter that is in the form of container, according to an embodiment of the present invention.
Figure 5:
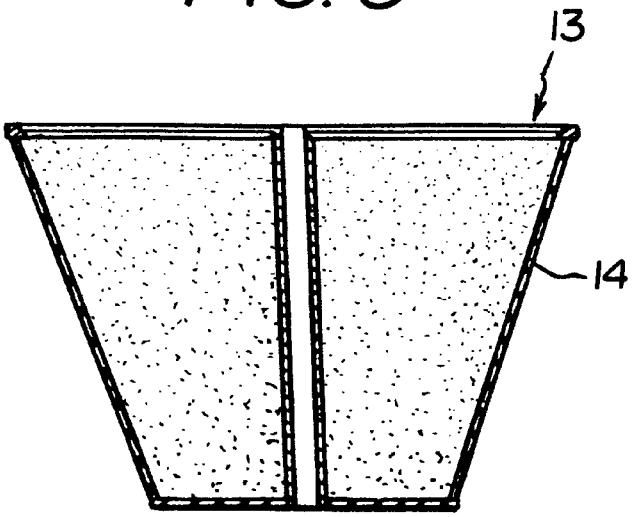
FIG. 5 is a schematic cross-sectional view showing the construction of an activated charcoal filter according to another embodiment of the present invention.
Figure 6:
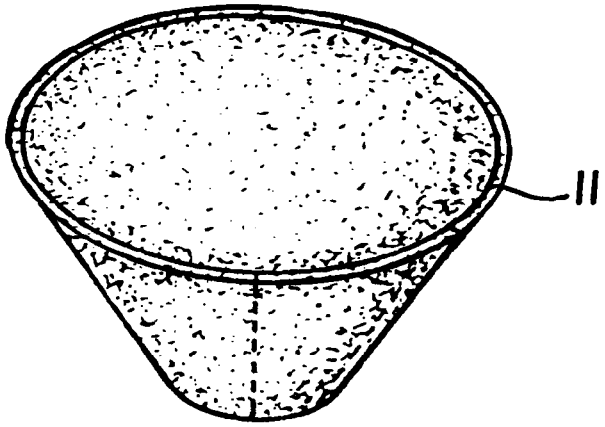
FIG. 6 is a schematic perspective view showing another embodiment of the activated charcoal filter according to the present invention.
Figure 7:
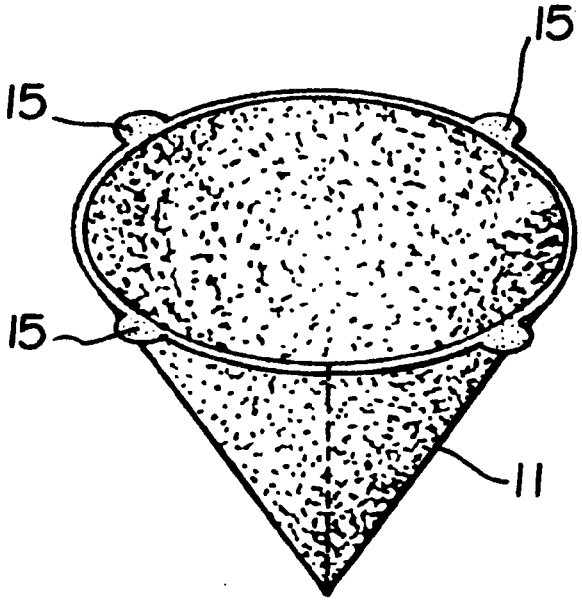
FIG. 7 is a schematic perspective view showing another embodiment of the activated charcoal filter according to the present invention.
Figure 8:
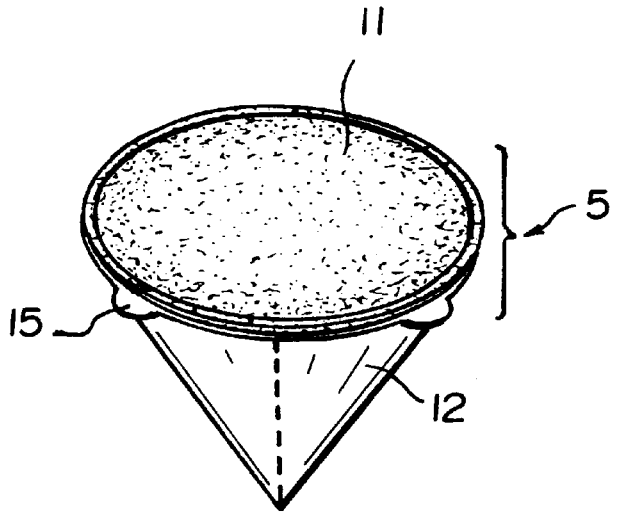
FIG. 8 is a schematic perspective view showing a filter means according to an embodiment of the present invention, which is in an assembled state.
Figure 9:
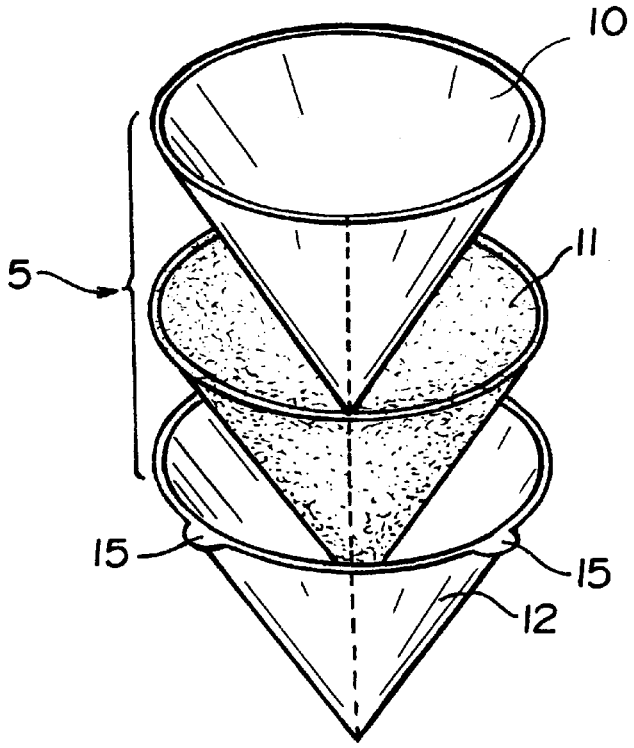
FIG. 9 is a schematic perspective view showing a filter means according to another embodiment of the present invention, which is disassembled.

In the filter means 5, the activated charcoal filter 11 and the static electricity filter 10 may be sequentially provided in the fixing frame 8 and the dust removing filter 12 may be provided outside the fixing frame 8, as shown in FIG. 3. Also, the activated charcoal filter 11 may be provided in the fixing frame 8 and the static electricity filter 10 and the dust removing filter 12 may be provided in sequence outside the fixing frame 8, if desired.

Referring to FIG. 2, the activated charcoal filter 11 may be formed with the container 13 of resin and the ventilative bag to be inserted in the container 13. The ventilative bag is made of non-woven or textile net impregnating the activated charcoal in its net. Also, the ventilative bag may be put with activated charcoal granules in its inner space, wherein the activated charcoal can be received in the form of cake or can be piled up.

Also, the activated charcoal filter 11 and the dust removing filter 12 of the filter means 5 are respectively formed with a plurality of wings 15 in their upper periphery, to confirm stable mounting of the activated charcoal filter 11 and the dust removing filter 12 by means of these wings 15.

As the above, if a vacuum cleaner accommodating the air filter of the present invention is driven by the motor, various sludge and gas are sucked into the intake port 2 of the dust collector 3 in a vortex flow and filtered primarily by means of the dust removing filter 12 to remove the dust and sludge, and next filtered by means of the activated charcoal filter 11 and the static filter 10 to remove the dust of micron unit, odor, gas, etc. completely, thereby discharging only filtered pure air.

Therefore, each kind of gas and odor including minute dust and inflammable gas as well as the sludge are all removed while passing through the static filters 10, the activated charcoal filter 11, the dust removing filter 12 by means of the filter networks, the activated charcoal ingredients and the static electricity, so that only the pure air passed through these filters may be deflated through the deflation hole 4 of the main body 1 of the cleaner, thereby performing air purification function as well as cleaning. The static electricity filter 10 sucks the activated charcoal ingredients by the static electricity when the activated charcoal ingredients are scattering, preventing sparks due to the scattering activated charcoal ingredients, so that the fire or the explosion owing to the inflammable gas can not occur even although the inflammable gas is sucked.

Further, by providing the outlet filter 7 to the fixing frame 6, even in case that the activated charcoal filter 11 or the static electricity filter 10 is not installed, it is possible to prevent the activated charcoal from scattering and permeating into the motor, making said filtering function certain. Furthermore, the wings 15 are selectively formed in said activated charcoal filter 11 and the dust removing filter 12 respectively and the wings are exposed outside the main body 1 of the cleaner a little, so that it is possible to easily confirm stable installation and existence and/or nonexistence of the filters by checking the state of the wing-exposure.

The present invention, as described above, it is possible to deflate only the pure air removing all the gas and odor included in the intaken materials through this filtering process while cleaning fine, and realize stable installation of the filters, by providing the filter means including the activated charcoal impregnated filter, the dust removing filter, and the static electricity filter to completely filter, each kind of sludge sucked into the dust collector of the vacuum cleaner.

Although the preferred embodiments of the present invention have been disclosed for illustrative purpose, those skilled in the art will appreciate that various modifications, additions and substitutions are possible, without departing from the scope and spirit of the invention as recited in the accompanying claims.

I claim:

1. An air filter for a vacuum cleaner including a dust collector having an intake port, a main body having a motor for originating vacuum and a deflation hole, and filter means provided between said dust collector and said main body, and wherein said main body includes a fixing part formed in the middle of a bottom part of said main body and having a peripheral stepped portion which is formed downwardly in a conic-shape, so that an outlet filter is mounted under a center part of said fixing part and a fixing frame formed with a number of intake slit is rotatable mounted under the peripheral stepped portion of said fixing part; and said filter means includes a static electricity filter which is charged with static electricity, an activated charcoal filter which is made of non-woven, papers, textiles, and has activated charcoal impregnated therein, and a dust filter which surrounds a periphery of the activated charcoal filter, the static electricity filter, the activated charcoal filter and the dust being formed conically to be fitted with said fixing frame successively.

2. The air filter for a vacuum cleaner of claim 1, wherein said static electricity filter and said dust removing filter are arranged outside the fixing frame, and said activated charcoal filter is arranged inside the fixing frame, in said filter means.

3. The air filter for a vacuum cleaner of claim 2, wherein the activated charcoal filter is formed as a container of resin having a ventilative bag of non-woven material impregnated with activated charcoal.

4. The air filter for vacuum cleaner of claim 1, wherein the activated charcoal impregnated in the non-woven material is piled up.

5. The filter for a vacuum cleaner of claim 1, wherein the activated charcoal filter and the dust removing filter of said filter means are respectively formed with a plurality of wings in upper periphery.

6. The air filter for a vacuum cleaner of claim 2, wherein the activated charcoal filter is formed as a container of resin having a ventilative bag of textile impregnated with activated charcoal.

7. The air filter for a vacuum cleaner of claim 2, wherein the activated charcoal filter is formed as a container of resin having a ventilative bag with activated charcoal granules.

8. The air filter for a vacuum cleaner of claim 1, wherein the activated charcoal filter is piled up in the textile.

9. The air filter for a vacuum cleaner of claim 1, wherein the activated charcoal filter is piled up with activated charcoal granules.

10. The air filter for a vacuum cleaner of claim 1, wherein said static electric filter and said activated charcoal filter are arranged inside the fixing frame, and said dust removing filter is arranged outside the fixing frame, in said filter means.

* * * * *

US006010550B1

(12) REEXAMINATION CERTIFICATE (4464th)

United States Patent

Song

(10) Number: US 6,010,550 C1

(45) Certificate Issued: Oct. 16, 2001

(54) AIR FILTER FOR A VACUUM CLEANER

(75) Inventor: Young-So Song, 5-103 Kaepo 1-Cha Woosung Apt., 503 Daechi 1-Dong, Kangnam-gu, Seoul (KR)

(73) Assignee: Young-So Song, Seoul (KR)

Reexamination Request:
No. 90/005,797, Aug. 25, 2000

Reexamination Certificate for:

| | |
|---|---|
| Patent No.: | **6,010,550** |
| Issued: | **Jan. 4, 2000** |
| Appl. No.: | **09/217,620** |
| Filed: | **Dec. 22, 1998** |

(30) Foreign Application Priority Data

Aug. 20, 1998 (KR) ..... 98-15646

(51) Int. Cl.[7] ..... B01D 53/04

(52) U.S. Cl. ..... 55/482; 55/485; 55/500; 55/529; 55/DIG. 3; 96/223

(58) Field of Search ..... 55/482, 485, 500, 55/529, DIG. 3; 96/223

(56) References Cited

U.S. PATENT DOCUMENTS

| | | | | |
|---|---|---|---|---|
| 4,236,902 | * | 12/1980 | Fricke . | |
| 4,365,980 | | 12/1982 | Culbert et al. . | |
| 4,504,290 | | 3/1985 | Pontius . | |
| 4,650,505 | | 3/1987 | Magdelain . | |
| 4,702,753 | | 10/1987 | Kowalczyk . | |
| 4,909,815 | | 3/1990 | Meyer . | |
| 5,159,738 | * | 11/1992 | Sunagawa et al. | 55/276 |
| 5,210,902 | * | 5/1993 | Lee et al. | 15/321 |
| 5,248,323 | * | 9/1993 | Stevenson . | |
| 5,287,591 | * | 2/1994 | Rench et al. . | |
| 5,307,538 | * | 5/1994 | Rench et al. . | |
| 5,352,256 | * | 10/1994 | Stead | 55/323 |
| 5,498,272 | * | 3/1996 | Leon | 55/363 |
| 5,593,479 | * | 1/1997 | Frey . | |
| 5,651,811 | * | 7/1997 | Frey . | |
| 6,090,184 | * | 7/2000 | Cartellone . | |

* cited by examiner

*Primary Examiner*—Chester T Barry

(57) ABSTRACT

An air filter for a vacuum cleaner to easily clear floors, carpets, chairs and so on includes a the main body having a motor and a deflation hole installed in a dust collector having an intake port, and a filter means provided between the dust collector and the main body, wherein the main body includes a fixing part formed in the middle of the bottom part to secure an outlet filter and having a peripheral stepped portion in a downward conic-shape to mount a fixing frame having a number of intake slit and the filter means to be installed to the fixing frame includes an activated charcoal filter, a dust removing filter and a static electricity filter to remove sludge, stink, offensive smell and gas generated from various materials in a room by means of these filters being easy to install in the vacuum cleaner.

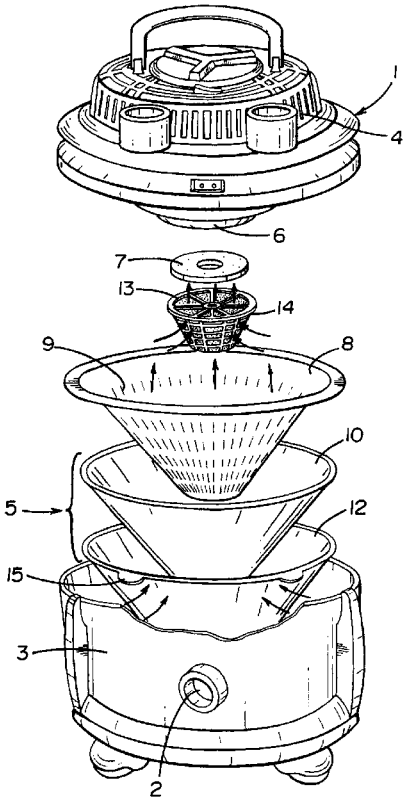

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 2, 3, 5 and 10 are cancelled.

Claims 1, 4 and 6–9 are determined to be patentable as amended.

New claim 11 is added and determined to be patentable.

1. An air filter for a vacuum cleaner including a dust collector having an intake port, a main body having a motor for originating vacuum and a deflation hole, and filter means provided between said dust collector and said main body, and wherein said main body includes a fixing part formed in the middle of a bottom part of said main body and having a peripheral stepped portion which is formed downwardly in a conic-shape, so that an outlet filter is mounted under a center part of said fixing part and a fixing frame formed with a number of intake slit*s* is [rotatable] *rotatably* mounted under the peripheral stepped portion of said fixing part; and said filter means includes a static electricity filter which is charged with static electricity, an activated charcoal filter which is made of non-woven, papers, textiles, and has activated charcoal impregnated therein, and a dust filter which surrounds a periphery of the activated charcoal filter, the static electricity filter, the activated charcoal filter and the dust *removing filter* being formed conically to be fitted with said fixing frame successively*; wherein said static electricity filter and said dust removing filter are arranged outside the fixing frame, and said activated charcoal filter is arranged inside the fixing frame, in said filter means, and the activated charcoal filter is formed as a container of resin having a ventilative bag of non-woven material impregnated with activated charcoal.*

4. The air filter for vacuum cleaner of claim 1, wherein [the] activated charcoal [impregnated in the non-woven material] is piled up *in the container*.

6. The air filter for a vacuum cleaner of claim [2] *1*, wherein the activated charcoal filter is formed as a container of resin having a ventilative bag of textile impregnated with activated charcoal.

7. The air filter for a vacuum cleaner of claim [2] *1*, wherein the activated charcoal filter is formed as a container of resin having a ventilative bag with activated charcoal granules.

8. The air filter for a vacuum cleaner of claim [1] *6*, wherein [the] activated charcoal [filter] is piled up *with*in the textile.

9. The air filter for a vacuum cleaner of claim 1, wherein the *impregnated* activated charcoal [filter] is [piled up with] activated charcoal granules.

*11. The air filter for a vacuum cleaner of claim 1, wherein the piled up activated charcoal is activated charcoal granules.*

* * * * *